United States Patent [19]

Wickham et al.

[11] Patent Number: 4,697,799

[45] Date of Patent: Oct. 6, 1987

[54] SUPPORT FOR PRECISELY HOLDING A WORKPIECE

[75] Inventors: John L. Wickham, Glenarm; Jeffrey D. Fox, Joppatowne, both of Md.

[73] Assignee: The J. L. Wickham Company, Inc., Baltimore, Md.

[21] Appl. No.: 838,131

[22] Filed: Mar. 10, 1986

[51] Int. Cl.[4] ..... B25B 1/20

[52] U.S. Cl. ..... 269/32; 269/93; 269/152; 269/231; 269/329

[58] Field of Search ..... 83/364; 269/329, 20, 269/23, 25, 32, 91–94, 152, 231

[56] References Cited

U.S. PATENT DOCUMENTS

| | | | |
|---|---|---|---|
| 1,948,799 | 2/1934 | Oyster | 269/32 |
| 3,592,093 | 7/1971 | Cantelli | 83/364 |
| 3,667,334 | 6/1972 | Brunett | 83/364 |
| 4,477,064 | 10/1984 | Di Giulio | 269/231 |
| 4,505,075 | 3/1985 | Salmon et al. | 83/364 |

*Primary Examiner*—Robert C. Watson

*Attorney, Agent, or Firm*—Cushman, Darby & Cushman

[57] ABSTRACT

A support for sensing the proper positioning of a workpiece and holding the workpiece for a machining operation in response to the proper positioning includes elements for sensing the position of the workpiece at a plurality of locations on the workpiece and a power drive mechanism for operating a clamp to secure the workpiece in the proper position. The sensing elements are connected in series to a power source and are actuated by engagement with predetermined locations on the workpiece when the workpiece is in the proper position. The clamp includes clamp arms which swing laterally away from seats for the workpiece as the clamp arms are moved forward to release one workpiece and accept another.

18 Claims, 6 Drawing Figures

SUPPORT FOR PRECISELY HOLDING A WORKPIECE

BACKGROUND OF THE INVENTION

The present invention relates to apparatus for quickly and precisely holding a workpiece for machining operations and, more particularly, to a power driven clamping device for securing the workpiece to a support and a mechanism for sensing the proper positioning of the workpiece and consequently actuating the clamping device.

Many precision machining operations can be performed by machines for which the workpieces are placed by hand onto a support and then fixed to the support. Although there is seldom a problem with securely fastening the workpieces to the support, some clamping devices have tended to slightly twist, deflect or otherwise distort the workpiece as they secure it for machining, which causes inaccuracy in the finished pieces. Furthermore, the hand placement of the workpieces is sometimes done carelessly, resulting in incorrectly positioned and, therefore, improperly machined workpieces. Even when done with care, a workpiece can be slightly out of position by an amount not apparent to the eye but sufficient to cause improper machining. In addition, many known workpiece holders have pivoting arms employing pivot pins which tend to rust in place over time, making removal of the pivoting arms and repair or rearrangement of the workpiece holder difficult.

SUMMMARY OF THE INVENTION

By the present invention, apparatus is provided which requires that each workpiece be in precisely the correct position on a support before a power driven clamping device is actuated to hold the workpiece in position on the apparatus for machining. In order to assure that the workpiece is in the correct position, a sensing mechanism senses the position of the workpiece at at least two points, thereby eliminating the possibility that one point on the workpiece might coincidentally be in its proper position while other portions of the workpiece are improperly positioned relative to the support. Furthermore, automatic securement of the workpiece is accomplished with only a simple, straight line placement of the workpiece against a seat on the support. Moreover, the clamping action avoids distorting the workpiece as the apparatus holds it for machining, and the apparatus avoids the use of parts which might hinder repair or rearrangement of the apparatus if they become immovable from rust.

The sensing mechanism includes a plurality of limit switches which are serially connected, requiring simultaneous operation in order to connect a power supply to a power driven mechanism for operating the clamping device. A corresponding plurality of locations on the workpiece engage and actuate the limit switches when the workpiece is in the proper position and, consequently, cause the operation of the power driven clamping device. The clamping device includes a bridge member mounted for movement relative to the support and a plurality of arms extending from the bridge member and through the support for engaging the workpiece at clamping stations suitable for securely fastening the workpiece to the side of the support opposite the bridge member. The arms are received in oversized slots in the support and are connected to the bridge member by connections which allow pivoting and sliding of the arms relative to the bridge member. Guide elements secured to the support cooperate with shoulders in the arms to swing the arms away from the seat for the workpiece to avoid interference with the placement of the workpiece against the seat in a straight line movement and to swing the arms toward the seat and into engagement with the workpiece in a snap action when the workpiece contacts the limit switches. Additional switches and clamping stations can be associated with the support so that workpieces of different shapes and/or sizes can be accommodated at different times on the same support.

DETAILED DESCRIPTION OF THE PREFERRED EMBODIMENTS

Figure 1:
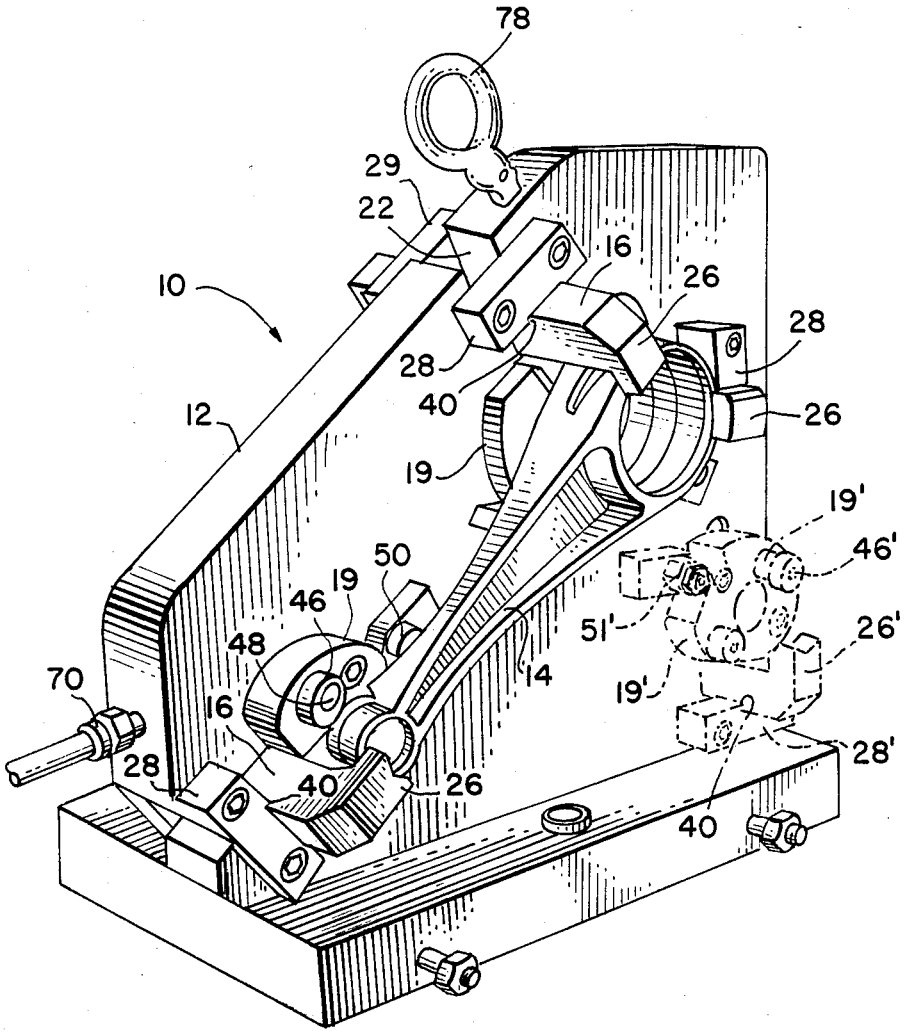
FIG. 1 is a perspective view of the workpiece holder according to the present invention showing the workpiece in position and an additional clamping station in phantom.

As can best be seen from FIG. 1, the workpiece holder according to the present invention, which is designated generally by the reference numeral 10, includes a support 12 to which a workpiece 14, such as a connecting rod for an engine, compressor or other machine, is held by a plurality of clamp arms 16 of a clamping device 18 (FIG. 4) for securely holding the workpiece during a machining operation or series of machining operations. The clamp arms 16 clamp the workpiece against seat plates 19 secured to the support 12 by suitable fasteners.

Figure 4:
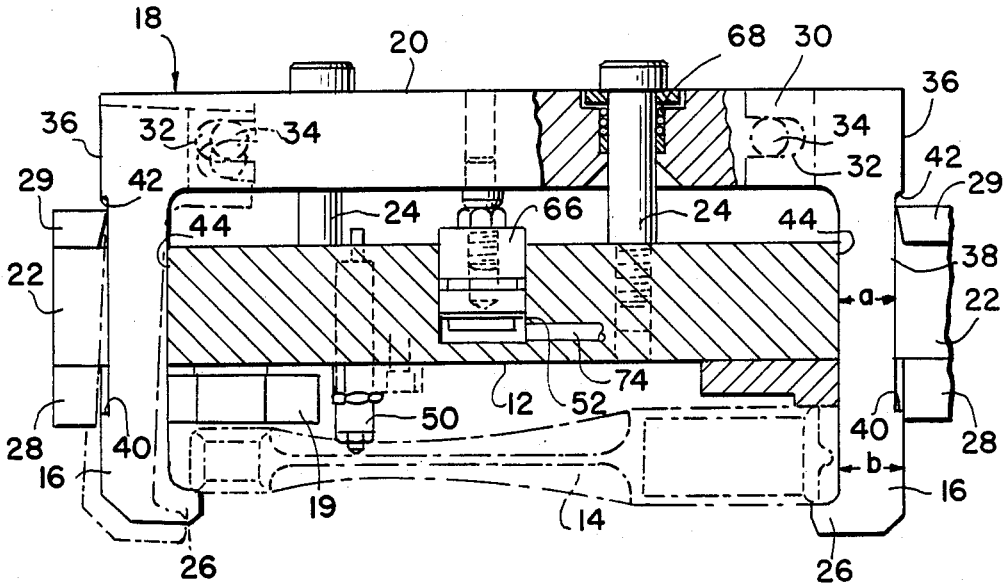
FIG. 4 is a partial top view of the workpiece holder of FIG. 3 with a cross section taken along the line 4—4 in the support.

As can be seen from FIG. 4, the clamp arms 16 are secured to a body portion, or bridge member 20, of the clamping device 18, and, in the embodiment shown, are mounted for sliding relative to the support 12. For this purpose, slots 22 each having a closed end and an opposite open end are defined in the support 12 adjacent the portions of the workpiece 14 to be clamped, and are, therefore, adjacent to the seat plates 19. The bridge member 20 is mounted for reciprocation on a guide element 24, such as a shoulder bolt, secured to the support 12 on a side of the support opposite the seat plates 19. The clamp arms 16 are supported for sliding movement in the slots 22 as the clamp arms are reciprocated relative to the support 12. The ends of the clamp arms 16 adjacent to the workpiece 14 are configured as fingers 26 to engage a predetermined portion of the workpiece 14 and clamp it against the seat plates 19. Although the embodiment of clamp arms 16 illustrated includes the fingers 26 extending from the clamp arms at right angles to engage the workpiece 14, it is understood that other configurations of the ends of the clamp arms which are especially suited to engage and clamp other workpieces can also be used. The clamp arms 16 occupy only the portion of the slots 22 adjacent the closed ends of the slots, leaving unoccupied space in the open ends of the slots. In order to retain the clamp arms 16 in the slots 22, guide elements 28 and 29 are secured across the slots, to the opposite sides of the support 12 between the clamp arms 16 and the open ends of the slots and in contact with the clamp arms. Thus, the clamp arms 16 are slidingly supported by the surfaces of the support 12 defining the slots 22, by guide surfaces on the seat plates 19, and/or by the guide elements 28 and 29.

The ends of the clamp arms 16 which are connected to the bridge member 20 define laterally extending bifurcations 30, each branch of which contains a slot 32 having an open end and a closed end. The bifurcations 30 project over ends of the bridge member 20 and along opposed surfaces of the bridge member at its ends. The slots 32 receive pins 34 extending from the opposed surfaces of the bridge member 20 at its ends, thereby defining connections which permit the clamp arms 16 to pivot and slide relative to the bridge member 20. A surface 36 of each clamp arm 16 adjacent to the guide elements 28 and 29 includes a recess 38 defined by shoulders 40 and 42, the recess 38 having a length greater than the distance between the distal surfaces of the guide elements 28 and 29. The distance between the guide element 29 and a surface 44 of the support 12 defining the closed end of the slot 22 is greater than the width a of the clamp arm 16 at the recess 38 but less than the width b of the clamp arm beyond the recess. Therefore, when the clamp arm 16 moves forward, the shoulder 42 engages the guide element 29 preventing further axial movement of the clamp arm 16 and causing the clamp arm to swing away from the associated seat plate 19 to the position shown in phantom in FIG. 4, since the connection of the pins 34 of the bridge member 20 and the slots 32 in the clamp arm 16 is offset, with respect to the axial movement of the clamp arm, from the point of contact between the shoulder 42 and the guide element 29. The surface of the guide element 29 engaging the clamp arm 16 is tapered to provide a relief clearance for accommodating the outward swing.

The distance between the guide element 28 and the seat plate 19, which is flush with the surface 44 of the support 12 defining the closed end of the slot 22, is greater than the width b of the clamp arm 16 outside the recess 38, thus providing clearance for the clamp arm 16 to swing outward from the seat plate 19 when the clamp arm moves forward and the recess 38 receives the guide element 28, thereby providing an unobstructed path for a workpiece 14 to be pushed straight into contact with the seat plate 19. When the clamp arm 16 moves back, the shoulder 40 engages the guide element 28 and initially prevents further rearward movement of the clamp arm. However, the offset position of the connection between the clamp arm 16 and the bridge member 20 causes the end of the clamp arm adjacent the guide element 28 to be urged toward the seat plate 19, a movement which is momentarily resisted by the force of static friction or "stiction". Additional rearward movement of the bridge member 20 overcomes the static friction and swings the clamp arm 16 toward the seat plate 19 and into engagement with the workpiece 14 in a snap action. Simultaneously, the clamp arm 16 moves farther rearward so that a portion of the clamp arm forward of the recess 38 contacts the guide element 28, which thereby maintains the clamp arm in clamping engagement against the workpiece 14.

Figure 2:
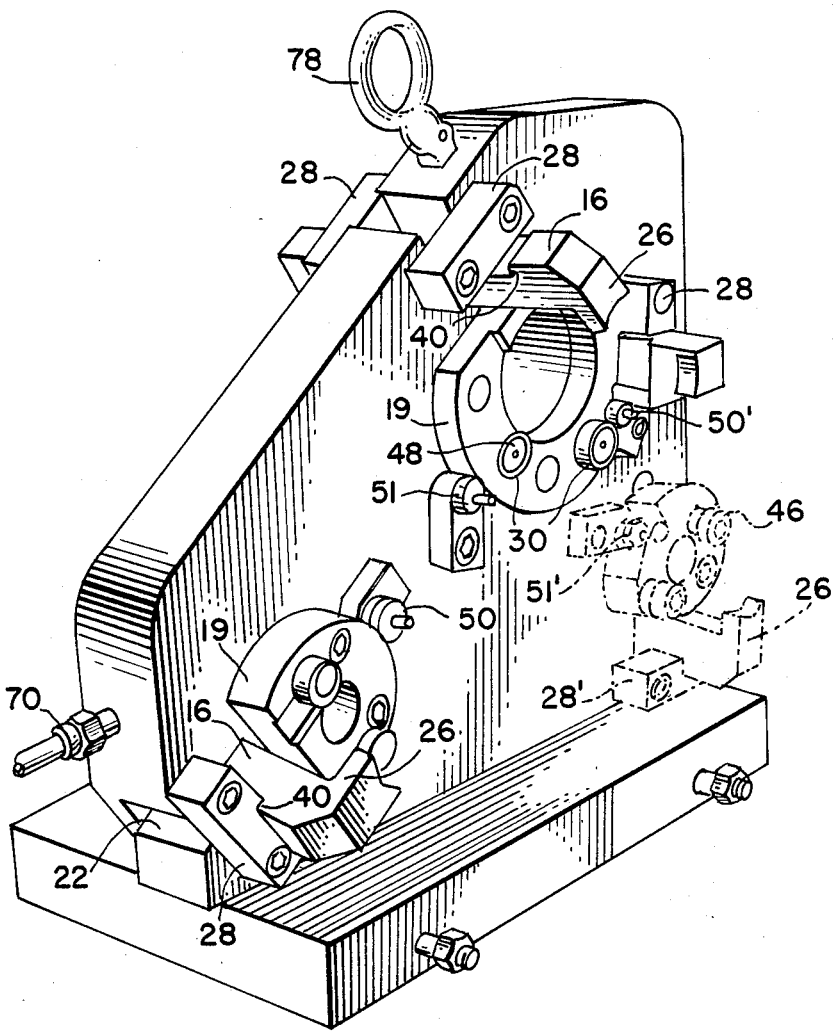
FIG. 2 is a perspective view of the workpiece holder of FIG. 1 with the workpiece removed.
Figure 3:
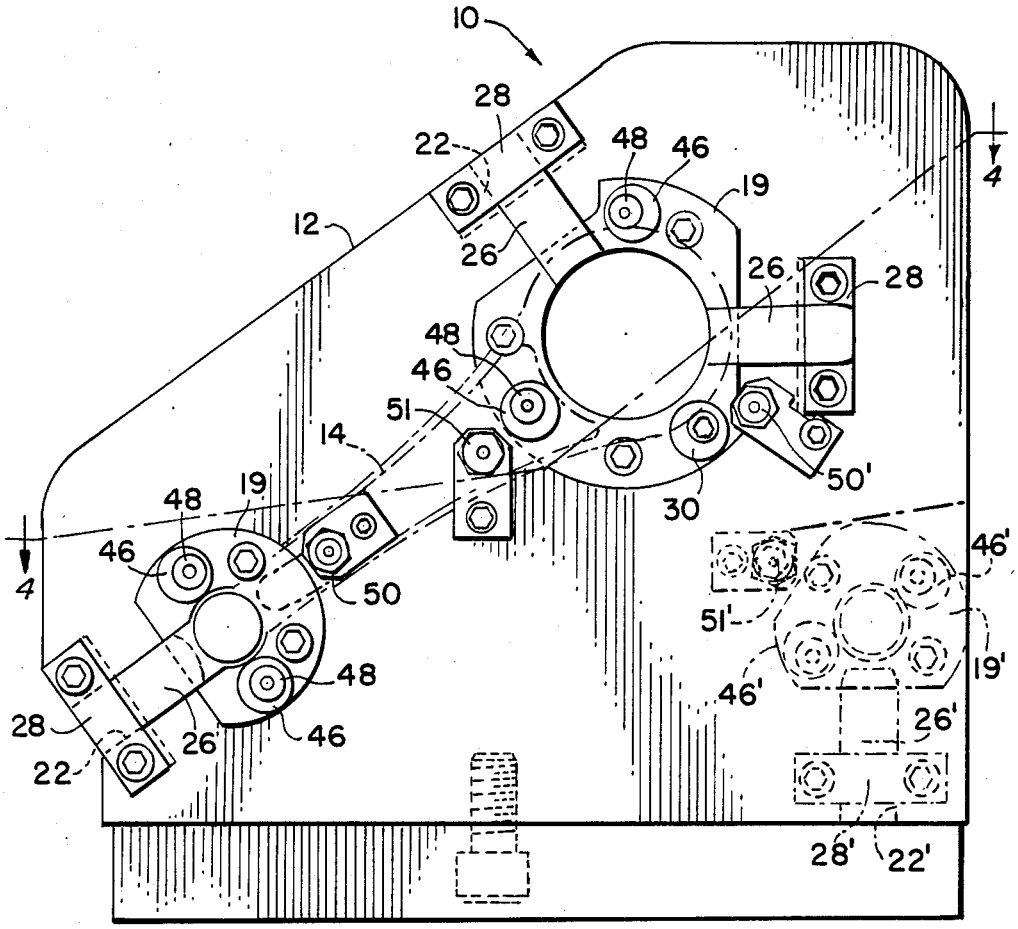
FIG. 3 is a front view of the workpiece holder of FIG. 2.

As can best be seen from FIGS. 1–3, discs 46 for preventing movement of the workpiece 14 transverse to the faces of the seat plates 19 are each adjustably secured to the seat plates to precisely define with the seat plates a seat for the workpiece 14 by engagement of an area on the peripheral surface of each disc 48 with a surface on the workpiece. A threaded fastener 48, such as a screw, extends through an eccentrically located bore in the disc 46 to allow the disc to be rotated, when the fastener is loose, whereby the disc adjusts the precise seating of the workpiece 14 on the support 12.

Figure 5:
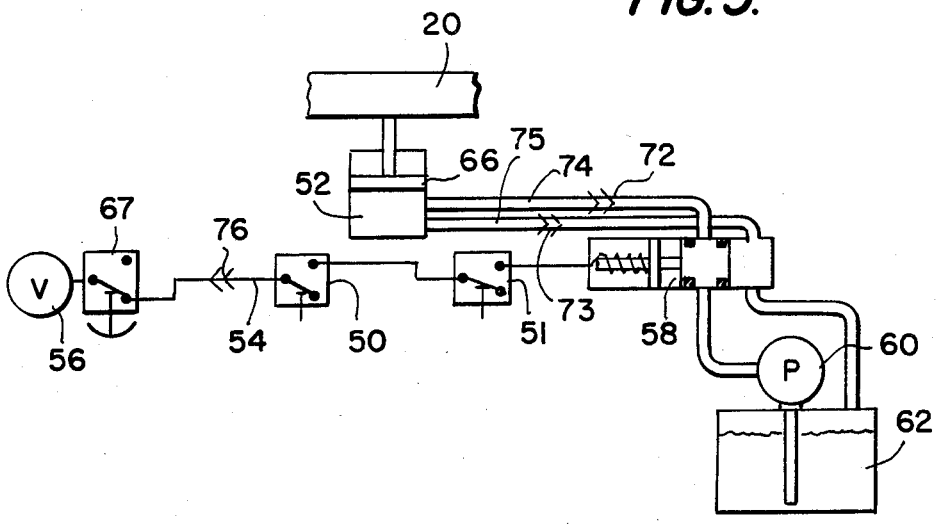
FIG. 5 is a schematic illustration of a power circuit for supplying power to the clamping device.

In order to determine that the workpiece 14 is in the correct position for the machining operation or operations, sensing elements 50 and 51 are provided at at least two points on the support 12 corresponding to at least two locations on the workpiece. The sensing elements 50 and 51 (FIGS. 2 and 3), which, in the embodiment illustrated, are electrical limit switches, operate in response to the correct positioning of the workpiece 14 to actuate a power drive mechanism 52 (FIG. 4) for moving the clamping device 18 to an actuated position in which it clamps the workpiece against the seat plates 19 on the support 12. As can best be seen from FIG. 4, the sensing element 50 is actuated by engagement with a predetermined location on the workpiece 14, but only when the location is precisely the distance from the support 12 which requires the workpiece to be in the correct position for proper machining of the workpiece. Similarly, the switch 51 is actuated by engagement with the workpiece 14 only when its associated location on the workpiece is precisely the correct distance from the support 12. As is illustrated in FIG. 5, the sensing elements 50 and 51 are arranged in series in a control line 54 for controlling the flow of power from a power source 56 to a power drive mechanism 58. Since each sensing element 50 and 51 is moved to its "ON", or operative, position in response to the correct positioning of its associated location on the workpiece 14, and since the sensing elements are arranged in series, all of the sensing elements, in this case, the two sensing elements 50 and 51, must be in the operative position simultaneously to cause the flow of power from the power source 56 to the power drive mechanism 58 for actuating the clamping device 18.

The sensing elements 50 and 51 control the flow of electricity from a power source 56 to an electrically operated valve 58, for example, which controls the flow of a pressurized fluid, such as hydraulic fluid, fed by a pump 60 from a reservoir 62, to a power drive mechanism 52 and the return flow from the power drive mechanism to the reservoir. In the illustrated embodiment, the power drive mechanism 52 is a hydraulic cylinder defined in the support 12 and contains a piston 66 connected to the bridge member 20 of the clamping device 18, so that movement of the piston 66 operates the clamping device. Thus, when the workpiece 14 is in the correct position, both of the sensing elements 50 and 51 are moved to their operative positions, thereby actuating the electrically operated valve 58 to permit the flow of hydraulic fluid to the power drive mechanism 52. The pressure of the hydraulic fluid on the bottom of the piston 66 forces the piston away from the bottom of the power drive mechanism 52, thereby moving the bridge member 20 away from the support 12 and the ends 26 of the clamp arms 16 against the workpiece 14 on the opposite side of the support to clamp the workpiece against the seat plates 19. If desired, three or more points on the workpiece 14 can be sensed by three or more sensing elements arranged along the power line in series. When the machining operations are complete, the flow of hydraulic fluid to the power drive mechanism 52 is shut off, for example, by the actuation of a manually operated, normally closed switch 67 mounted in series with the sensing elements 50 and 51, which cuts off power to the electrically operated valve 58 to cause it to return by the action of a spring (not shown), for example, to a position in which the flow of hydraulic fluid from the pump 60 is stopped and return flow of the fluid to the reservoir 62 is permitted. The hydraulic fluid is forced from the power drive mechanism 52, the clamping device 18 is moved to its release position and the workpiece 14 is released, all by the forward movement of the bridge member 20, which is effected by a spring, such as by a return spring 68 associated with the guide element 24 on which the bridge member 20 is mounted for reciprocation. Rather than employing the manually operated switch 67, the sensing elements 50 and 51 can be connected in series to a master control system for operating the machine performing the machining operations, so that the workpiece 14 can be released automatically in response to the completion of the machining operations.

Hoses may be provided to conduct the hydraulic fluid to and from the power drive mechanism 52, or internal passages may be formed in the support 12, in which case a connector 70 (FIGS. 1 and 2) is mounted on a surface of the support to connect the internal passages to the source of hydraulic fluid. The electrically operated valve 58 is preferably positioned on the machine on which the support 12 is secured, so that other clamping supports designed to hold, for machining, parts of different configurations may be substituted for the first support without providing an electrically operated valve on each support. Instead, quickly disconnecting connectors 72 and 73 are provided in hydraulic lines 74 and 75, as is shown in FIG. 5, and similarly a plug 76 can be provided in the electrical line 54 to the sensing elements 50 and 51 to allow quick disconnection of the sensing elements from the power source 56. In addition, a ring 78 (FIGS. 1 and 2) for lifting and moving the support 12, for example, from a storage area to a machine to perform the necessary operations, is also provided.

Although a hydraulic system has been specifically described, it is understood that a pneumatic system in which the sensing elements 51 and 52 are pneumatic switches, the electrically operated valve 58 is pneumatically operated, and the power drive mechanism 52 is a pneumatic cylinder can be used as an alternative. Furthermore, the entire system can be electrical, in which case electrical switches comprising the sensing elements can connect an electrical power source directly to a solenoid for moving the bridge member 20, thereby actuating the clamping device 18.

In order that the workpiece holder 10 can be used for workpieces of different configurations, additional, alternate elements can be provided on the support to permit the precise positioning of such other workpieces. For example, as is shown in phantom in FIGS. 1–3, an alternate seat plate 19' can be secured to the support 12 adjacent to an alternate clamp arm 16' received for sliding reciprocation in a slot 22' defined in the support and contacted by guide elements 28' secured across the slot 22' on opposite sides of the support. Adjustable eccentric disks 30' are secured to the alternate seat plate 19' for providing a precise and adjustable seat for the portion of a workpiece which will be clamped into position by the alternate group of elements. Such alternate elements can operate with one of the sets of elements used to hold the workpiece 14 in order to hold a different workpiece, such as a connecting rod of different length. Two sensing elements 50' and 51' are positioned for actuation by different portions of the different workpiece, and are mounted in series in a power line like the sensing elements 50 and 51 associated with the workpiece of the first configuration. The seat plate 19', clamp arm 16' and adjustable eccentric disks 46' used in clamping the different workpiece can be the same as the corresponding elements used to clamp workpieces of the first configuration. Thus, the positioning and sensing of the workpiece of alternate configuration is accomplished in the same manner as that of the workpiece of the first configuration.

Figure 6:
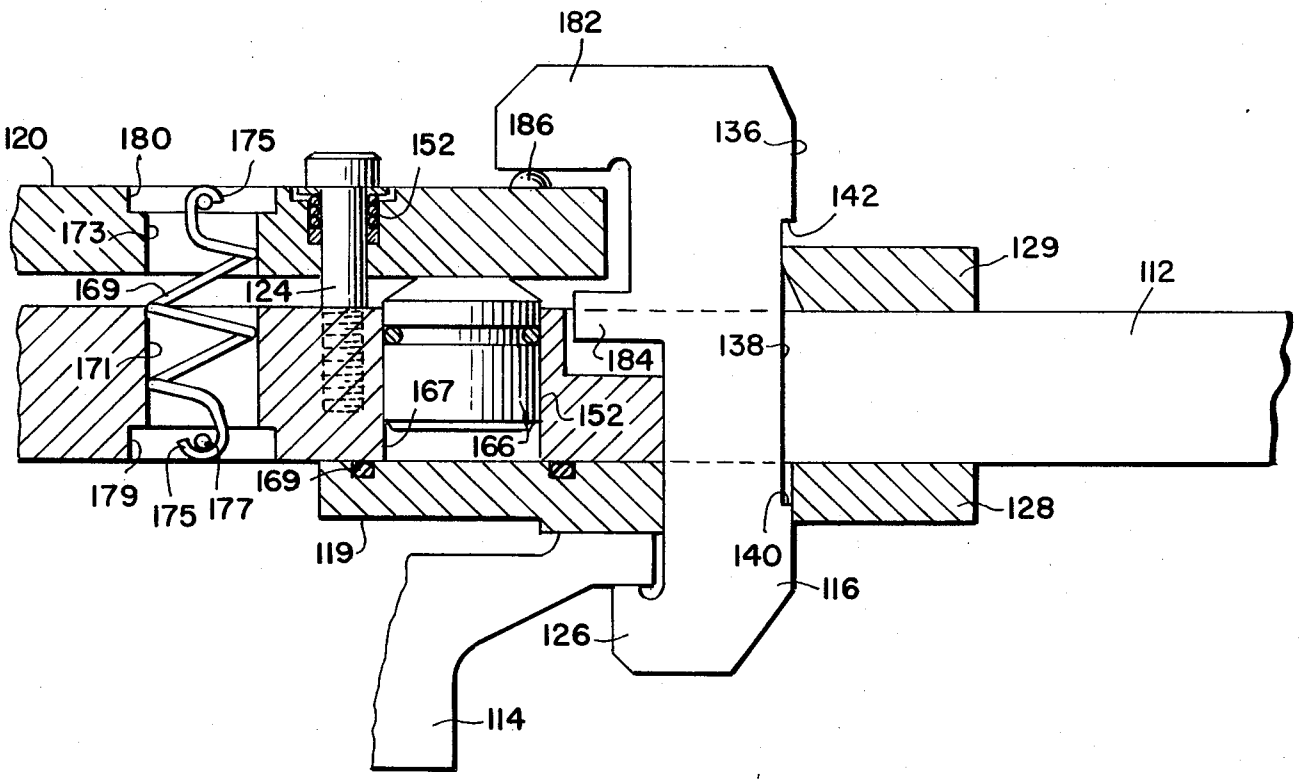
FIG. 6 is a partial cross section, similar to FIG. 4, of an alternate embodiment of the workpiece holder according to the present invention.

In an alternate embodiment of the workpiece holder 10 according to the present invention, as is illustrated in FIG. 6, a support 112 has an associated power drive mechanism 152 including a piston 166 and a cylinder 167 defined by a bore extending completely through the support 112. One end of the cylinder 167 is closed by a seat plate 119, which has a seal 169 to prevent leakage from the cylinder and fasteners such as screws (not shown) to secure the seat plate 111 to the support 112. The opposite end of the cylinder 167 remains open, and the piston 166 contacts a bridge member 120 lying across the open end and protrudes from the open end to move the bridge member 120 away from the support 112. The bridge member reciprocates on guide elements 24, one of which is shown, and the return movement of the bridge member 120 toward the support 112 is accomplished by a spring 169 positioned within bores 171 and 173 formed in the support 112 and the bridge member 120, respectively. The ends of the spring 169 have hooks 175 for anchoring the spring to rods 177 secured across the bores 171 and 173 in counterbores 179 and 180.

The clamp arm 116 includes a major lateral projection 182 and a minor lateral projection 184, both extending from the longitudinal axis of the clamp arm 116 toward the bridge member 120 and receiving between them a portion of the bridge member. As with the clamp arm 16 of the embodiment of FIGS. 1–5, a surface 136 of the clamp arm 116 adjacent to the guide elements 128 and 129 includes a recess 138 defined by shoulders 140 and 142, and the recess has a length greater than the distance between the distal surfaces of the guide elements 128 and 129. The distances between the guide element 129 and the opposing surfaces of the support 112 and bridge member 120 prevent the shoulder 142 from moving forward past the guide element 129, but the distances between the guide element 128 and the opposing surfaces of the seat plate 119 and the support 112 allow the shoulder 140 to move rearward past the guide element 128. Therefore, the clamp arm 116 operates in a manner similar to the operation of the clamp arm 16 of the first embodiment. However, the connection between the bridge member 120 and the clamp arm 116 differs from the connection of the first embodiment. The bridge member 120 includes a protrusion 186 extending rearward into contact with the major lateral projection 182 of the clamp arm 116 to move the clamp arm 116 rearward in response to the actuation of the power drive mechanism 152. Since the clamp arm 116 swings with respect to the bridge member 120 as they move rearward, the protrusion 186 is provided with a curved surface, such as that of a hemisphere, to facilitate the turning and sliding of the clamp arm relative to the bridge member. Upon forward movement, the bridge member 120 engages the minor lateral projection 184 and thereby pushes the clamp arm 116 forward and swings it laterally outward away from the seat plate 119.

Although the embodiment of the present invention described herein provides sensing elements for two locations on the workpiece, it is understood that sensing elements could be provided at three or more locations on the workpiece. Furthermore, it will be appreciated by those skilled in the art and it is contemplated that other variations in the embodiments illustrated and described herein may be made without departure from the present invention. Accordingly, it is intended that the foregoing description is illustrative only, not limiting, and that the true spirit and scope of the present invention is determined by the appended claims.

What is claimed is:

1. Apparatus for sensing the precise positioning of a workpiece and holding the workpiece for a machining operation comprising:

a support;

means for sensing the proper positioning of the workpiece relative to said support at a plurality of locations on the workpiece;

means, responsive to said sensing means, for clamping the workpiece in the proper position on a first side of said support;

said clamping means including at least first and second clamp elements connected by a body portion means, said body portion means positioned on a side of said support opposite said first side and movable to first and second positions to cause said connected clamp elements to move into and out of engagement with the workpiece; and power drive means connected to said body portion means for moving said body portion between said first and second positions in response to proper positioning of the workpiece sensed by said means for sensing.

2. Apparatus according to claim 1 wherein said sensing means comprises means for operatively connecting said power drive means to a first power source in response to the proper positioning of the workpiece.

3. Apparatus according to claim 2 wherein said power drive means comprises a pressure fluid cylinder, said first power source comprises a pressure fluid source, and said sensing means comprises a sensing element positioned at each of said plurality of locations, said apparatus further comprising a power operated valve controlling the flow of pressure fluid from said pressure fluid source to said pressure fluid cylinder, each said sensing element being connected in series in a power line between a second power source and said power operated valve to control the flow of power through the power line from the second power source to said power operated valve.

4. Apparatus according to claim 3 wherein each said sensing element includes a control element actuated by engagement with the associated location on a properly positioned workpiece.

5. Apparatus according to claim 2 wherein said support has first and second opposite sides, and aperatures extending between said opposite sides, said body portion and said power drive means are positioned on said second side of said support and the workpiece is positioned on the said first side of said support, and said clamping elements extend through said aperatures in said support.

6. Apparatus according to claim 5 wherein said clamping elements are slidably supported in said apertures.

7. Apparatus according to claim 5, wherein said apertures are slots.

8. Apparatus according to claim 3 wherein said pressure fluid cylinder is defined in said support.

9. Apparatus according to claim 1, further comprising adjustable means on said support for defining a seat for the workpiece.

10. Apparatus according to claim 9 wherein said adjustable seat defining means comprises a disc element having an eccentric opening and a releasable fastener fixing said disc element to said support.

11. Apparatus according to claim 2, further comprising guide means for supporting said body portion for reciprocating movement relative to said support.

12. Apparatus according to claim 6, further comprising guide elements positioned adjacent to said apertures, a seat on said support for receiving the workpiece, means for pivotally and slidingly connecting said clamping elements to said body portion, and a shoulder on each of said clamping elements engageable with one of said guide elements for causing said clamping elements to swing away from said seat.

13. Apparatus for holding a workpiece for a machining operation comprising:

a support having front and rear sides and apertures extending between said sides;

guide elements adjacent to said apertures;

a seat on said front side of said support for receiving the workpiece;

clamping elements for clamping the workpiece to said seat, said clamping elements extending through said apertures;

power drive means on said rear side of said support for moving said clamping elements into engagement with the workpiece;

a body portion connected to said power drive means;

means for pivotally and slidingly connecting said clamping elements to said body portion; and a first shoulder on each of said clamping elements engageable with one of said guide elements for causing said clamping element to swing away from said seat.

14. Apparatus according to claim 13, further comprising a second shoulder on each of said clamping elements engageable with one of said guide elements for causing said clamping element to swing toward said seat.

15. Apparatus according to claim 14 wherein said second shoulder engages one of said guide elements at a place adjacent said front side of said support and across said aperture from said seat for the workpiece, and said means for pivotally and slidingly connecting said clamping elements to said body portion is offset, in a direction transverse to the longitudinal axis of the clamping element, toward said seat and away from said place of engagement between said second shoulder and one of said guide elements, whereby the rearward movement of said body portion urges said clamping element to overcome momentary static friction between said second shoulder and one of said guide elements and swing toward said seat with a snap action.

16. Apparatus according to claim 15 wherein said connecting means comprises a pin on one of said body portion and said clamping element and a slot on the other of said body portion and said clamping element.

17. Apparatus according to claim 15 wherein said connecting means comprises lateral projections on said clamping elements, said body portion extending between said lateral projections.

18. Apparatus according to claim 17 wherein said connecting means further comprises a protrusion on said body portion and in engagement with one of said lateral projections.

* * * * *